US010172758B1

(12) United States Patent
Downs

(10) Patent No.: US 10,172,758 B1
(45) Date of Patent: Jan. 8, 2019

(54) PORTABLE STRETCHING DEVICE

(71) Applicant: Curtis Downs, North Richland Hills, TX (US)

(72) Inventor: Curtis Downs, North Richland Hills, TX (US)

( * ) Notice: Subject to any disclaimer, the term of this patent is extended or adjusted under 35 U.S.C. 154(b) by 212 days.

(21) Appl. No.: 15/264,770

(22) Filed: Sep. 14, 2016

Related U.S. Application Data

(60) Provisional application No. 62/221,795, filed on Sep. 22, 2015.

(51) Int. Cl.
*A63B 23/04* (2006.01)
*A61H 1/02* (2006.01)
*A63B 23/00* (2006.01)

(52) U.S. Cl.
CPC ..... *A61H 1/0237* (2013.01); *A61H 1/02* (2013.01); *A61H 1/0244* (2013.01); *A63B 23/04* (2013.01); *A61H 2001/0248* (2013.01); *A63B 2023/006* (2013.01); *A63B 2210/50* (2013.01)

(58) Field of Classification Search
CPC ..... A63B 23/0488
See application file for complete search history.

(56) References Cited

U.S. PATENT DOCUMENTS

| | | | | |
|---|---|---|---|---|
| 4,456,247 | A | 6/1984 | Ehrenfried | |
| 4,647,040 | A | 3/1987 | Ehrenfried | |
| 4,781,373 | A * | 11/1988 | Irwin | A63B 23/0488 482/131 |
| 4,844,453 | A | 7/1989 | Hestilow | |
| 5,137,504 | A | 8/1992 | Mangini | |
| 5,626,547 | A | 5/1997 | Davies, III et al. | |
| 5,904,641 | A | 5/1999 | Huang | |
| 5,938,573 | A | 8/1999 | Davies, III et al. | |
| 6,234,935 | B1 * | 5/2001 | Chu | A63B 21/018 482/51 |
| 6,352,495 | B1 | 3/2002 | Hsu | |
| 6,821,231 | B1 | 11/2004 | Hall | |
| 7,896,398 | B2 * | 3/2011 | Suda | B25G 3/10 285/7 |
| 2014/0338583 | A1 * | 11/2014 | Xin | A63B 35/10 114/315 |

OTHER PUBLICATIONS

Title Boxing, ProForce StretchMaster, 2015, www.titleboxing.com/news/, 2 pages.

* cited by examiner

*Primary Examiner* — Loan H Thanh
*Assistant Examiner* — Rae Fischer

(57) ABSTRACT

A portable stretching device is provided having a gear housing and gear mechanism that move stretching poles in opposing rotational directions to provide a maximum stretching position.

20 Claims, 4 Drawing Sheets

PORTABLE STRETCHING DEVICE

CROSS-REFERENCE TO RELATED APPLICATION

This Application claims the benefit of U.S. Provisional Application Ser. No. 62/221,795 filed on Sep. 22, 2015, entitled "PORTABLE STRETCH MACHINE," commonly assigned with the present invention and incorporated herein by reference.

TECHNICAL FIELD

Embodiments of this disclosure are directed to a portable stretching device having a gear housing and gear mechanism that move leg poles in opposing rotational directions to provide a maximum and controlled stretching position.

BACKGROUND

Stretching is an important for people of all ages to maintain good health and physical posture and strength. Stretching is particularly important for athletes or anyone who is involved in sports activities or just general exercise. Additionally, stretching is beneficial to people who have undergone physically therapy to recover from surgery or an injury. Often times, people do not take the time to stretch, and as a result, either re-injure themselves or incur a new injury. Consistent stretching is known to improve flexibility, range of motion, circulation, overall muscular health and elasticity of muscles, endurance and metabolism, just to name a few of the benefits associated with stretching.

Even though stretching provides a person's body with numerous health benefits, it is often a neglected aspect of fitness. A primary reason for this may be that stretching to a person's full potential is difficult. Though there are machines that can help a person stretch properly, they often are bulky or do not allow a person to achieve a fully stretched position.

SUMMARY

One embodiment of this disclosure provides a portable stretching device. This embodiment comprises a gear housing having one or more rotation slots located in and extending laterally along a sidewall thereof. A first gear wheel is rotatably coupled to and located within the gear housing and has a first pole coupler attached thereto. A second gear wheel is rotatably coupled to and located within the gear housing and has a second pole coupler attached thereto. Gear teeth of the first gear wheel cooperatively engage gear teeth of the second gear wheel. A directional switching gear is rotatably coupled to and located within the gear housing and has opposing gear teeth engagable with gear teeth of the first gear wheel. The directional switching gear further has a directional switch coupled thereto.

In another embodiment, the portable stretching device comprises a gear housing having one or more rotation slots located in and extending laterally along a sidewall thereof, a first gear wheel is rotatably coupled to and located within the gear housing and has a first pole coupler attached thereto. The first gear wheel is coupled to a lever arm that extends outside of the gear housing. A second gear wheel is rotatably coupled to and located within the gear housing and has a second pole coupler attached thereto. Gear teeth of the first gear wheel cooperatively engage with gear teeth of the second gear wheel. A first leg pole is attached to the first pole coupler and a second leg pole is attached to the second pole coupler. A directional switching gear is rotatably coupled to and located within the gear housing and has opposing gear teeth engagable with gear teeth of the first gear wheel. The directional switching gear further has a directional switch coupled thereto.

The foregoing has outlined preferred and alternative features of the present disclosure so that those skilled in the art may better understand the detailed description of the invention that follows. Additional features of various embodiments of this disclosure are described hereinafter that form the subject of the claims. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the disclosure.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
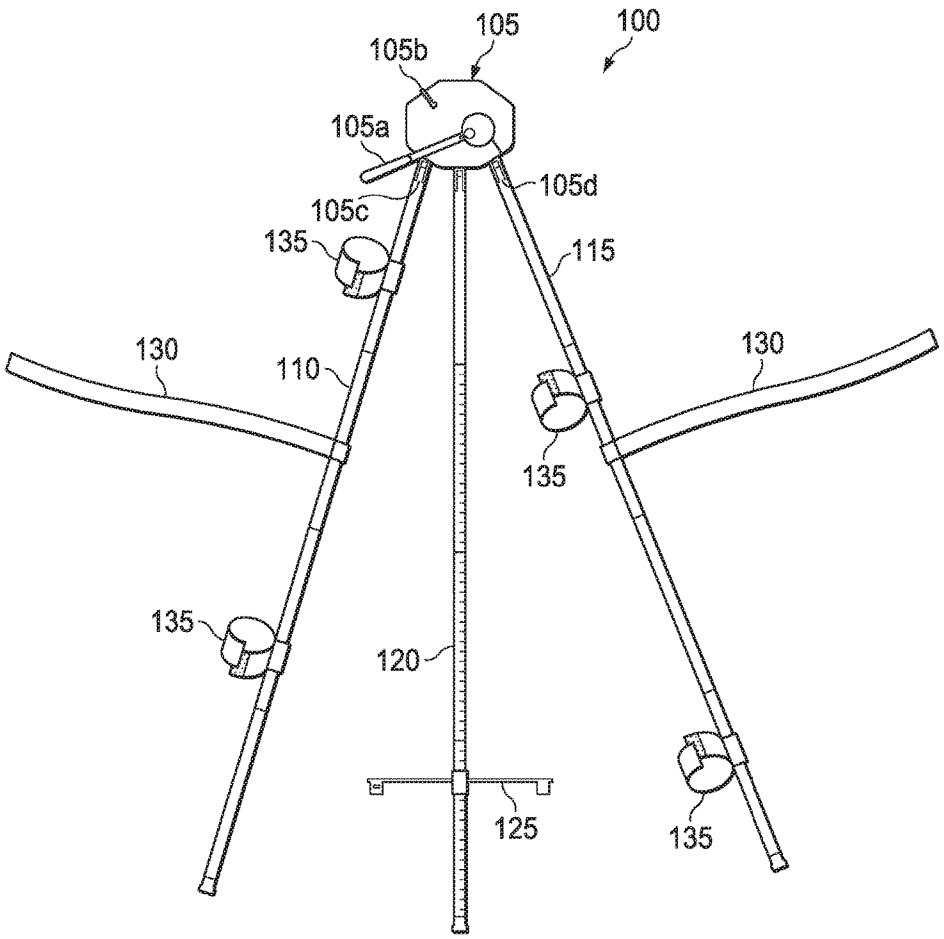
FIG. 1 illustrates an embodiment of the portable stretching device.

This disclosure presents, in its various embodiments, a portable stretching device that is lightweight and compact that allows the device to be carried from one location to another easily. This device addresses the problems associated with heavy bulky stretching machines that cannot be moved or transported easily. Additionally, this compact, lightweight device provides adequate structure that aids the user in achieving maximum stretching positions, unlike resistance bands and other similar known systems. In certain embodiments, the portable stretching device can collapse down to roughly eighteen inches, so it can be easy to pack it on the go. Whether going to a gym, dance studio, or traveling out of town, the portable stretching device is small and lightweight enough to place in any bag or suitcase.

In an embodiment of the portable stretching device, leg poles extend along the each of the user's leg and certain designs allow the device to expand to a length of four feet. A crank, or gear housing, is used to maximize distance of each stretch as well as hold the position. With the portable stretching device holding the position for the user, the user is free to use his or her hands to stretch properly without hindering posture or distorting the back. In the gear housing, there is a center slot that is stationary without movement. Placing a leg pole in this position enables one to stretch one leg at a time. This stationary position also allows one to insert a stretching bar to maximize ones stretch. Moreover, unlike most stretch machines, the portable stretching device accommodates multiple stretches/positions.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings, with the understanding that they serve as examples and that they do not limit the disclosure to only the illustrated embodiments. Moreover, it is fully recognized that the different teachings of the embodiments discussed, infra, may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements but include indirect interaction between the elements described, as well. Additionally, in the following discussion and in the claims, the terms "including" and "comprising" are used in an open-ended fashion, and thus should be interpreted to mean "including, but not limited to." Further, any references to "first," "second," etc. do not specify a preferred order of method or importance, unless otherwise specifically stated, but such terms are intended to distinguish one element from another. For example, a first element could be termed a second element, and, similarly, a second element could be termed a first element, without departing from the scope of example embodiments. Moreover, a first element and second element may be implemented by a single element able to provide the necessary functionality of separate first and second elements.

The phrase "removably coupled," including grammatical variations thereof, as used herein and in the claims, means that the recited element is not integrally formed with or attached in a more permanent fashion to the recited element. Moreover, it is attached in a manner that allows it to be connected or disconnected easily, such as by well-known quick-connect/release mechanisms, (including screws or bolts), examples of which are discussed below. The phrase "removably coupled" is contrasted to more permanent means of attachment, such as welds, brads, or stamp pressing. The term "attached," including grammatical variations thereof, as used herein and in the claims, encompasses instances where the element is permanently attached or removably coupled. The phrase "rotatably coupled," including grammatical variations thereof, as used herein and in the claims, means that the recited element, can rotate with respect to the element to which it is coupled. The phrase "slidably attached," including grammatical variations thereof, as used herein and in the claims, means that the recited element is coupled in a manner that allows it to slide along a length of the element to which it is coupled. The phrase "cooperatively engage," including grammatical variations thereof, as used herein and in the claims, means that the recited elements contact each other directly, or indirectly and collectively operate with respect to each other to achieve the purposed or stated function.

The various characteristics mentioned above, as well as other features and characteristics described in more detail below, are readily apparent to those skilled in the art with the aid of this disclosure upon reading the following detailed description of the embodiments, and by referring to the accompanying drawings.

FIG. 1 illustrates an embodiment of a portable stretching device 100, as provided herein. The portable stretching device may be used to stretch the arms or legs by attaching the device to the user's body in the appropriate manner. The various components that make up the embodiments of the portable stretching device 100 may be made from any lightweight and sturdy material, such as aluminum, thick plastics, graphite materials, small gage steel, or combinations thereof, as design specifications might require. In the illustrated embodiment, the portable stretching device 100 comprises a gear housing 105. As explained below, the gear housing 105 has gears in it and a lever arm 105*a* and a directional switch 105*b* that allow the gears to turn in different directions. Additionally, pole couplers 105*c*, 105*d* are attached to a gear located within the gear housing 105. The pole couplers 105*c*, 105*d* are accessible through one or more rotation slots formed in a sidewall of the gear housing 105, and in an embodiment, the pole couplers 105*c*, 105*d* extend through the rotation slot(s) and outside the gear housing 105. However, in another embodiment, the pole couplers 105*c*, 105*d* may be located wholly within the gear housing. In such embodiments, a leg pole would be coupled to the pole coupler and extend through the rotation slot(s). In one aspect of this embodiment, leg poles 110, 115 may be attached or removably coupled to the gear housing 105 by way of the pole couplers 105*c*, 105*d*. The gears within gear housing 105 allow the leg poles 110, 115 to rotate about the gear housing 105 at different angles to provide different stretching angles for the user. The leg poles 110, 115 may be coupled to pole couplers 105*c*, 105*d* by a frictional fit, such as where the leg poles 110, 115 either slide over or into respective pole couplers 105*c*, 105*d* that are attached to the gear housing 105. In another embodiment, the poles 110, 115 may be removably coupled to the gear housing 105 by way of the pole couplers 105*c*, 105*d* by a conventional spring button mechanism, as described below. In one embodiment, the portable stretching device 100 may further comprise a center stretching bar 120, or pole, that is removably coupled to the gear housing 105 and may be coupled to the gear housing 105 in the same manner as the leg poles 110, 115. However, unlike the leg poles 110, 115 that can rotate with respect to the gear housing 105, the stretching bar 120 is fixed with respect to the gear housing 105 and is not configured to rotate. As mentioned above, in place of a stretching bar 120, a leg pole may be inserted when the user desires to stretch only one leg at a time. The stretching bar 120, in certain embodiments, includes a handle 125 that is slidably attached to the stretching bar 120 that provides stability to the user as he or she bends forward in a stretching movement.

In some embodiments, the lever arm 105*a* may not be present, in such embodiments, the portable stretching device 100 may include gripping straps 130 that are attached to the leg poles 110, 115. The gripping straps 130 may be attached to the leg poles 110, 115 in a number of ways, such as by snaps, brads, or velcro systems. The gripping straps 130 allow the user to pull, for example, the legs further apart to obtain a maximum stretched position in place of using the lever arm 105*a*. In certain embodiments, the portable stretching device 100 may further include securing straps 135 attached to the leg poles 110, 115 by which a user can a secure his or her legs to the leg poles 110, 115. The securing straps 135 may be attached to the leg poles 110, 115 in the same manner as the gripping straps 130.

Figure 2:
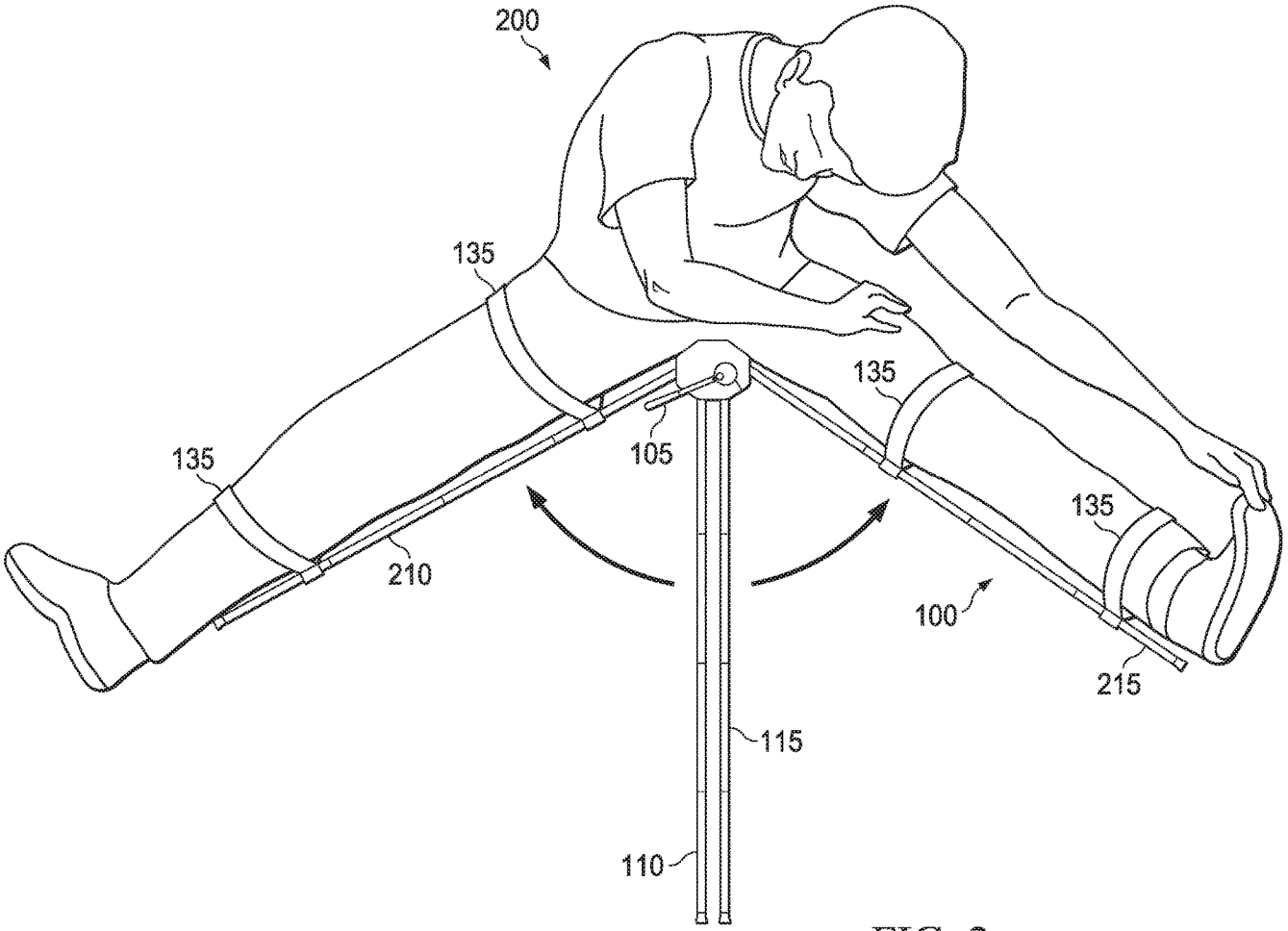
FIG. 2 illustrates one use of an embodiment of the portable stretching device.

FIG. 2 merely illustrates one way in which a user 200 can use an embodiment of the portable stretching device 100. In this embodiment, the user 200 is using the portable stretching device 100 to obtain a maximum stretch of the legs. As seen here, the user's 200 legs are secured to the leg poles 110, 115 of the portable stretching device 100 by the securing straps 135. As seen in FIG. 2, the gear housing 105 is located in a centered position with respect to the user's 200 legs, and the leg poles 110, 115 are rotated outwardly (as indicated by the directional arrows) or away from that center position to a stretching position indicated by rotated leg poles 210, 215. Though the stretching bar 120 is not shown in this embodiment, in other embodiments, it may be present, and when present, the user 200 may use it to stretch down the center of the portable stretching device 100, as indicated by the leg poles 110 115 prior to being rotated to a stretching position.

Figure 3A:
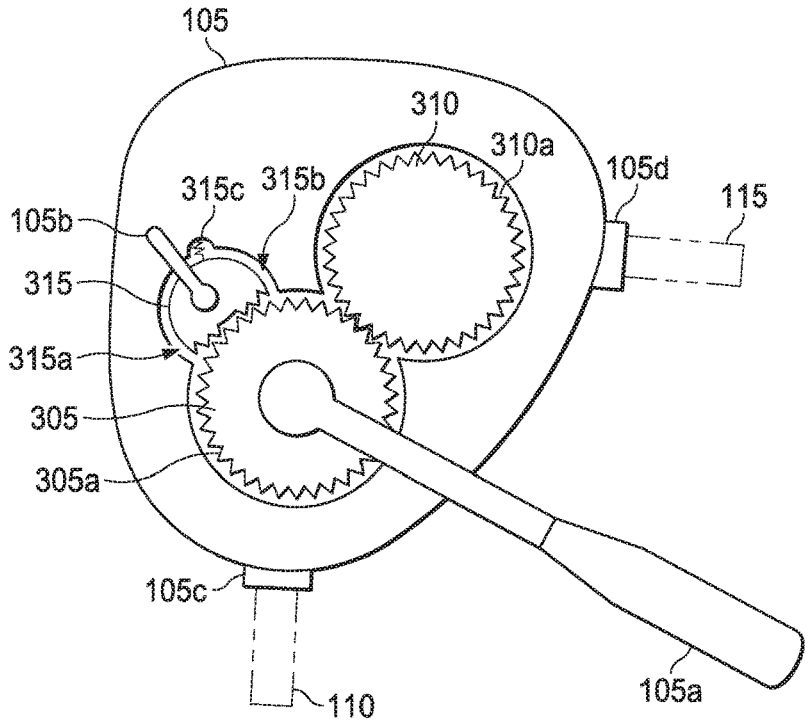
FIG. 3A illustrates an interior topside view of an embodiment of the stretching device.
Figure 3B:
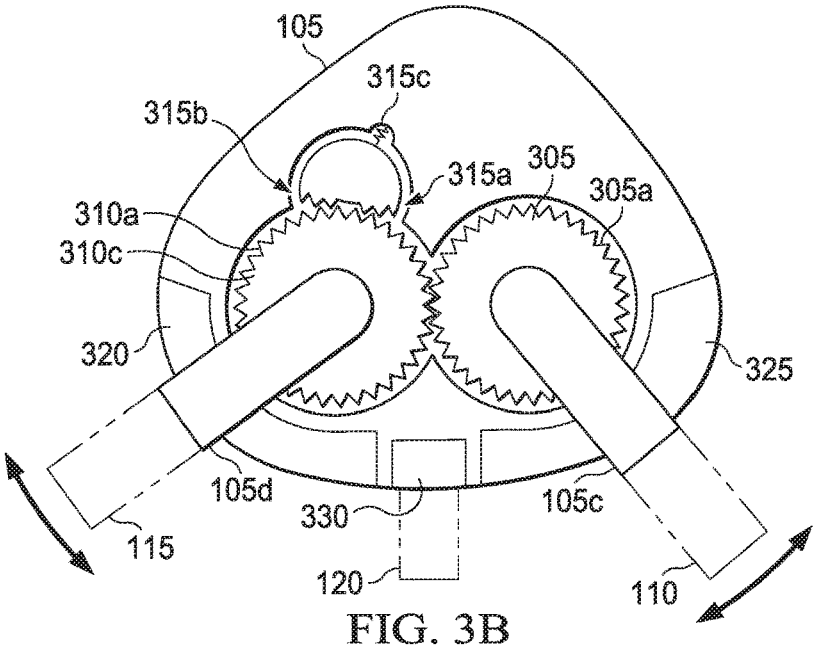
FIG. 3B illustrates an interior bottom side view of an embodiment of the stretching device.

FIGS. 3A-3B illustrate an embodiment of the gear housing 105, without the optional leg poles 110, 115. In this embodiment, the gear housing comprises a first gear wheel 305 that is rotatably coupled to and located within the gear housing 105. The first gear wheel 305 has gear teeth 305*a* located about its perimeter. The pole coupler 105*c* is attached to the first gear wheel 305. The gear housing 105 further includes a second gear 310 that is rotatably coupled to and located within the gear housing 105. The second gear wheel 310 has gear teeth 310*a* located about its perimeter. It should be understood that the gear size and number of teeth may vary by design for both gear wheels 305, 310. The pole coupler 105*d* is attached to the second gear wheel 310. The gear teeth 305*a* and 310*a* cooperatively engage each other in a conventional manner, as shown, such that one gear will turn the other. Though first and second gear wheels are shown, other embodiments may include additional gear wheels, for example, to increase the torque of the device. Additionally, the embodiments of the first gear wheel 305 may include a conventional ratcheting mechanism that will allow the user to ratchet the lever arm 105*a* in a back and forth motion.

The gear housing 105 further includes a biased, directional switching gear 315 that is rotatably coupled to and located within the gear housing 105. The switching gear 315, which is coupled to the directional switch 105*b*, has opposing gear teeth 315*a*, 315*b* that can be moved to engage the gear teeth 305*a* of the gear wheel 305 to prevent it from rotating in an undesired direction, as explained below. The directional switch 105*b* is coupled to the switching gear 315. As noted above, the directional switch 105*b* can be moved to allow rotation of the gear wheel 305 in a clockwise or counter-clockwise direction, depending on the desired rotation of the leg poles 110, 115. In an embodiment, the switching gear 315 is biased by a spring 315*c*. In other embodiments, the directional switch 105 may be positioned to cooperate with gear wheel 310 in the same manner as described with respect to gear wheel 305.

FIG. 3B illustrates one or more rotation slots 320, 325, and fixed slot 330, that extend along a lateral side of the gear housing 105, as shown. The rotation slots 320, 325 provide a rotational path (indicated by the arrows) to allow the leg poles 110, 115 to rotate with respect to the gear housing 105. Though more than one rotation slot is shown, other embodiments provide one rotation slot with the fixed slot located in a central location of the rotational path. Rotation slots 320, 325 accommodate movement of the leg poles 110, 115, while fixed slot 330 accommodates the fixed stretching bar or one of the leg poles 110, 115, if desired. In an embodiment, fixed slot 330 is integrally formed in the gear housing 105, or in another embodiment, it may be a coupler that is attached to the gear housing 105 into which the stretching bar 120 may be inserted.

Figure 4A:
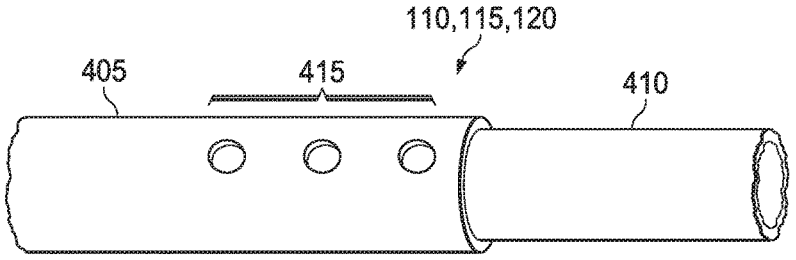
FIG. 4A illustrates a view of one embodiment of a quick-connect/release mechanism.
Figure 4B:
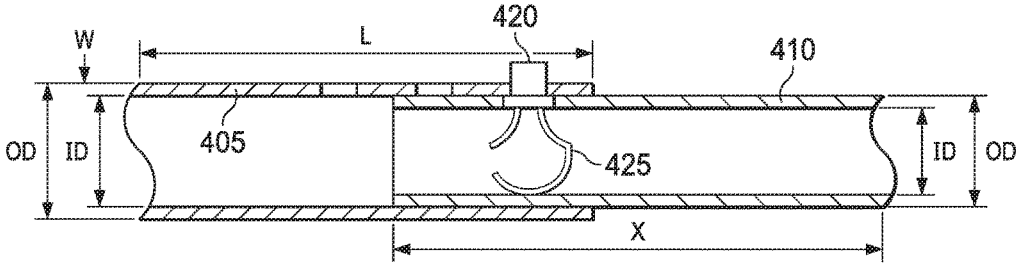
FIG. 4B illustrates a sectional view of the embodiment of FIG. 4A.

FIGS. 4A and 4B illustrate an embodiment of a quick-connect/release mechanism that can be used to removably attach the leg poles 110, 115, or stretching bar 120 to the gear housing 105. FIG. 4A illustrates telescoping pole sections 405, 410 that may comprise the leg poles 110, 115, or stretching bar 120. The telescoping pole sections 405, 410 may be of conventional design, and though only two pole sections are illustrated, other embodiments may include more than two telescoping pole sections. One or more spaced apart button openings 415 are formed along a longitudinal length of pole section 405 and are configured or designed to receive a locking button 420 therethrough. In an embodiment, the locking button 420 is biased through the button opening 415 by a spring 425. The telescoping pole sections 405, 410 may have the same length or different lengths. In the illustrated embodiment, pole section 405 is longer than pole section 410. Additionally, pole section 405 has an inner diameter (ID) that is larger than an outer diameter (OD) of pole section 410, which allows a portion of pole section's 410 length X to be received within a portion of pole section's 405 length L. As seen in FIG. 4B, the locking button 420 is received in the button opening 415 that allows for the longest length in this embodiment. This configuration allows for easy adjustment of the length of the leg poles 110, 115 or stretching bar 120 to accommodate different leg or arm lengths of a given user, while at the same time allowing the portable stretching device to be very compact and portable. The locking button is but one conventional mechanism that can be used in the embodiments of the portable stretching device 100. It should be understood that other conventional locking mechanisms, such a threaded "A" clutch, split collar lock, internal cam lock, G-snap collar locks, or set knob mechanisms may be used in place of the locking button configuration.

With various embodiments described, a method of using the embodiment of FIG. 1 will now be described. The user may deploy the portable stretching device. In those embodiments, where the poles are not attached, the user may easily attach the leg poles to the respective pole couplers using one of the quick-connect/release mechanisms discussed above. At this point, the leg poles are located in a central, or non-rotated, position with respect to the gear housing. If the user desires to stretch his or her legs, the user may adjust the leg poles to the appropriate length in those embodiments where the leg poles are telescoping, as discussed above. The user could then position himself in a non-stretched position and attach each of the leg poles to his or her legs. The user would then set the directional switch, so that when the user rotates or ratchets the lever arm attached to the first gear wheel in a clockwise direction, the gear teeth of the first gear wheel cooperates with the gear teeth of the second gear wheel to rotate the second gear wheel in a counter-clockwise direction. This action rotates the leg poles in opposite directions and spread the user's legs apart. During this procedure, the opposing teeth on the directional gear prevent the first gear wheel from turning in a counter-clockwise direction and the second gear wheel from turning in a clockwise direction, to ensure that the user does not inadvertently try to push his or her legs back together. The user may continue rotating or ratcheting the lever arm to spread the legs further apart until a maximum stretch is achieved. The user holds this position for a prescribed period of time. Additionally, the user may bend his or her upper body along the right leg or left leg.

If the stretching bar is attached, the user may at this time use the stretching bar to bend his or her body toward the stretching bar by the user placing his or her hands on the hand bars and sliding the handle bar along the stretching bar. Once, the stretching time has lapsed, the user then moves the direction switch in an opposite direction, which allows, the first gear wheel to rotate in a counter-clockwise direction and the second gear wheel to rotate in a clockwise direction. During this procedure, the opposing teeth on the directional gear are set to prevent the first gear wheel from turning in a clockwise direction and the second gear wheel from turning in a counter-clockwise direction, thereby allowing the user to bring his or her legs back together. It should be understood that this mode of operation would be reversed in those embodiments where the lever arm is coupled to the opposite gear wheel.

The foregoing listed embodiments and elements do not limit the disclosure to just those listed above, and those skilled in the art to which this application relates will appreciate that other and further additions, deletions, substitutions and modifications may be made to the described embodiments.

What is claimed is:

1. A portable stretching device, comprising a gear housing having one or more rotation slots located in and extending laterally along a sidewall of said gear housing;

a first gear wheel rotatably coupled to and enclosed within said gear housing and having a first pole coupler attached to said first gear wheel;

a second gear wheel rotatably coupled to and enclosed within said gear housing and having a second pole coupler attached to said second gear wheel, wherein gear teeth of said first gear wheel cooperatively engage with gear teeth of said second gear wheel; and a directional switching gear rotatably coupled to and enclosed within said gear housing and having opposing gear teeth engagable with said gear teeth of said first gear wheel, and further having a directional switch coupled to said directional switching gear.

2. The portable stretching device of claim 1, wherein said first and second pole couplers rotate within and extend through said one or more rotation slots to an exterior of said gear housing.

3. The portable stretching device of claim 1, further comprising a first leg pole removably attachable to said first pole coupler and a second leg pole removably attachable to said second pole coupler.

4. The portable stretching device of claim 3, comprising gripping straps attached to each of said first and second leg poles.

5. The portable stretching device of claim 3, wherein said first and second leg poles each comprise a plurality of telescoping pole sections.

6. The portable stretching device of claim 3, further comprising securing straps attached to said first and second poles.

7. The portable stretching device of claim 5, wherein said telescoping leg pole sections comprise at least a first and second pole sections wherein said first pole section has an interior diameter larger than an outer diameter of said second pole section, said first pole section having one or more spaced apart button openings located along a longitudinal length thereof configured to receive a locking button therethrough, said second pole section having a spring biased button, wherein a spring located within an interior diameter of said second pole section urges said locking button through an opening located in said second pole section.

8. The portable stretching device of claim 1, further comprising a fixed center pole coupler located within a fixed center slot and attached to said gear housing and located between said first and second pole couplers.

9. The portable stretching device of claim 7, further comprising a stretching bar removably attachable to said fixed center pole coupler, said stretching bar having a handle bar that is slideably coupled to said stretching bar.

10. The portable stretching device of claim 1, further comprising a lever arm attached to said first wheel and extending outside of said gear housing.

11. The portable stretching device of claim 1, wherein said directional switching gear is spring biased.

12. The portable stretching device of claim 1, wherein said directional switch has a lever arm that extend outside of said gear housing.

13. A portable stretching device, comprising:

a gear housing having one or more rotation slots located in and extending laterally along a sidewall of said gear housing;

a first gear wheel rotatably coupled to and enclosed within said gear housing and having a first pole coupler attached thereto, said first gear wheel being coupled to a lever arm that extends outside of said gear housing;

a second gear wheel rotatably coupled to and enclosed within said gear housing and having a second pole coupler attached thereto, gear teeth of said first gear wheel cooperatively engaged with gear teeth of said second gear wheel;

a first leg pole attached to said first pole coupler and a second leg pole attached to said second pole coupler; and a directional switching gear rotatably coupled to and located enclosed said gear housing and having opposing gear teeth engagable with gear teeth of said first gear wheel, said directional switching gear further having a directional switch coupled thereto.

14. The portable stretching device of claim 13, wherein said first and second pole couplers rotate within and extend through said one or more rotation slots to an exterior of said gear housing.

15. The portable stretching device of claim 13, wherein said first and second leg poles each comprise a plurality of telescoping pole sections.

16. The portable stretching device of claim 15, wherein said telescoping pole sections comprise at least a first and second pole section wherein said first pole section has an interior diameter larger than an outer diameter of said second pole section, said first pole section having one or more spaced apart button openings located along a longitudinal length thereof configured to receive a locking button therethrough, said second pole section having a spring biased button, wherein a spring located within an interior diameter of said second pole section urges said locking button through an opening located in said second pole section.

17. The portable stretching device of claim 13, further comprising a fixed center pole coupler attached to said gear housing and located between said first and second pole couplers.

18. The portable stretching device of claim 17, further comprising a stretching bar attached to said fixed center pole coupler.

19. The portable stretching device of claim 13, wherein said directional switching gear is spring biased.

20. The portable stretching device of claim 13, further comprising securing straps attached to said first and second poles.

* * * * *